US008350769B1

(12) United States Patent
Crawley

(10) Patent No.: US 8,350,769 B1
(45) Date of Patent: Jan. 8, 2013

(54) FREQUENCY AGILE ELECTRICALLY SMALL TACTICAL AM BROADCAST BAND ANTENNA SYSTEM

(75) Inventor: Ken Allen Crawley, Saint George, SC (US)

(73) Assignee: United States of America as represented by Secretary of the Navy, Washington, DC (US)

( * ) Notice: Subject to any disclaimer, the term of this patent is extended or adjusted under 35 U.S.C. 154(b) by 882 days.

(21) Appl. No.: 12/051,887

(22) Filed: Mar. 20, 2008

(51) Int. Cl.
*H01Q 9/00* (2006.01)

(52) U.S. Cl. ..... 343/745; 343/752

(58) Field of Classification Search ..... 343/713, 343/752, 808, 809, 828, 829, 745
See application file for complete search history.

(56) References Cited

U.S. PATENT DOCUMENTS 3,253,279 A * 5/1966 Tanner ..... 343/849
3,482,249 A * 12/1969 Mullaney ..... 343/750
3,604,008 A * 9/1971 Thowless ..... 343/745
5,673,055 A 9/1997 Hansen
6,188,366 B1 * 2/2001 Yamamoto et al. ..... 343/722

OTHER PUBLICATIONS

Yong-Woong Jang, Hyun-Chul Go, Sang-Woo Lee, A Low Profile, Top-loaded Monopole Antenna with Four Small Posts, Apr. 2006, Microwave Journal, vol. 49, No. 4, pp. 116-122.*

* cited by examiner

*Primary Examiner* — Jacob Y Choi
*Assistant Examiner* — Kyana R McCain
(74) *Attorney, Agent, or Firm* — Allan Y. Lee

(57) ABSTRACT

A Frequency Agile Electrically Small Tactical AM Broadcast Band Antenna System (NC#098978) comprising a transmitter, antenna, plurality of mast wires and configurable tophat assembly. The transmitter is designed to transmit radio frequency signals. The antenna tuning unit is operatively coupled to the transmitter and designed to tune the apparatus to a desired frequency. The plurality of mast wires operatively is coupled to the antenna tuning unit and designed to receive and output radio frequency signals. The configurable tophat assembly is operatively coupled to the plurality of mast wires. The configurable tophat assembly comprises a tophat disc comprising a conductive material, a plurality of tophat wires comprising a conductor material and a plurality of tophat jumpers designed to help configure said plurality of tophat wires to different lengths by providing electrical open and electrical short states.

20 Claims, 5 Drawing Sheets

300

FREQUENCY AGILE ELECTRICALLY SMALL TACTICAL AM BROADCAST BAND ANTENNA SYSTEM

FEDERALLY SPONSORED RESEARCH AND DEVELOPMENT

This invention (Navy Case No. 098978) is assigned to the United States Government and is available for licensing for commercial purposes. Licensing and technical inquiries may be directed to the Office of Research and Technical Applications, Space and Naval Warfare Systems Center, Code 51000-CTO, N. Charleston, S.C., 29419; voice (843) 218-4000; email T2@spawar.navy.mil. Reference Navy Case Number 098978.

BACKGROUND OF THE INVENTION

The Frequency Agile Electrically Small Tactical AM Broadcast Band Antenna System is generally in the field of antenna systems.

Typical antenna systems require a broadcast engineer to setup and maintain the antenna system, which is expensive. In addition, typical antenna systems require power shutdowns to tune the antenna system.

A need exists for an antenna system that does not require a broadcast engineer to setup and maintain the antenna system. In addition, a need exists for an antenna system that does not require power shutdowns to tune the antenna system.

BRIEF DESCRIPTION OF THE DRAWINGS

All FIGURES are not drawn to scale.

DETAILED DESCRIPTION OF THE INVENTION

Described herein is Frequency Agile Electrically Small Tactical AM Broadcast Band Antenna System.

DEFINITIONS

The following acronym(s) are used herein:

Acronym(s):

AM—Amplitude Modulation

ATU—Antenna Tuning Unit

FAAS—Frequency Agile electrically small tactical AM broadcast band antenna System Tx—Transmitter The frequency agile electrically small tactical AM broadcast band antenna system includes a transmitter, an antenna tuning unit (ATU) and an antenna mast. The transmitter is operatively coupled to the ATU and is designed to transmit AM radio frequency signals to the ATU. The ATU is operatively coupled to the antenna mast and is designed to tune the antenna system to a desired frequency. The antenna mast includes a support mast and an electric mast. The ATU is operatively coupled to the electric mast. The support mast is designed to provide physical support for the electric mast.

Figure 1:
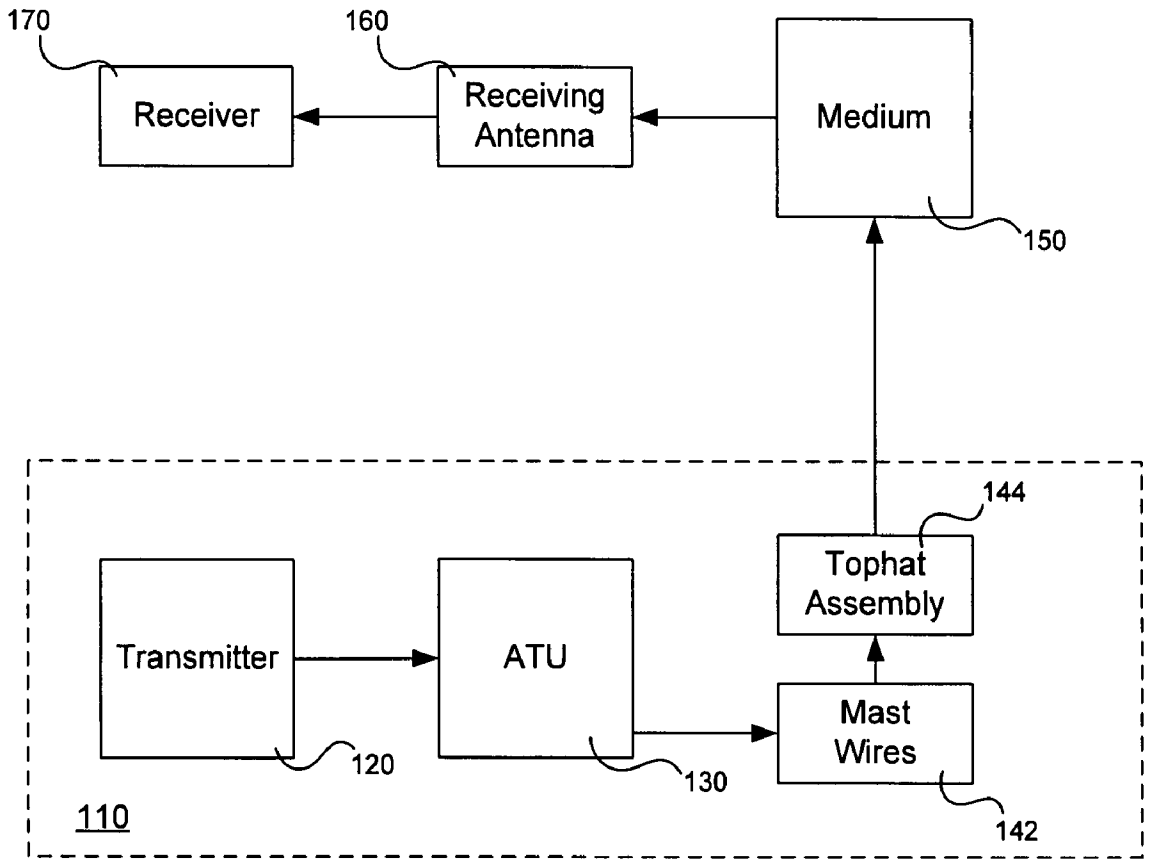
FIG. 1 is a block diagram of one embodiment of a Frequency Agile Electrically Small Tactical AM Broadcast Band Antenna System.

FIG. 1 is a block diagram of one embodiment of a frequency agile electrically small tactical AM broadcast band antenna system (FAAS). As shown in FIG. 1, FAAS 110 includes transmitter 120, ATU 130, mast wires 142 and configurable tophat assembly 144. In one embodiment, transmitter 120 comprises an AM transmitter. Transmitter 120 is operatively coupled to ATU 130 and is designed to transmit AM radio frequency signals to ATU 130. ATU 130 is designed to tune FAAS 110 to a desired frequency. ATU 130 is operatively coupled to ground for electric reference purposes. In one embodiment, ATU is operatively coupled to a ground rod that is inserted into the ground, a ground radial wire assembly that spans an area around FAAS 110, and an ATU ground connection. ATU 130 is operatively coupled to mast wires 142.

Mast wires 142 receive AM radio frequency signals from ATU 130 and output AM radio frequency signals to configurable tophat assembly 144. Configurable tophat assembly 144 is operatively coupled to mast wires 142 and transmits AM radio frequency signals to receiving antenna 160 via medium 150. In one embodiment, medium 150 is air. Receiving antenna 160 is operatively coupled and outputs AM radio frequency signals to receiver 170. Receiver 170 receives and demodulates AM radio frequency signals.

Figure 2:
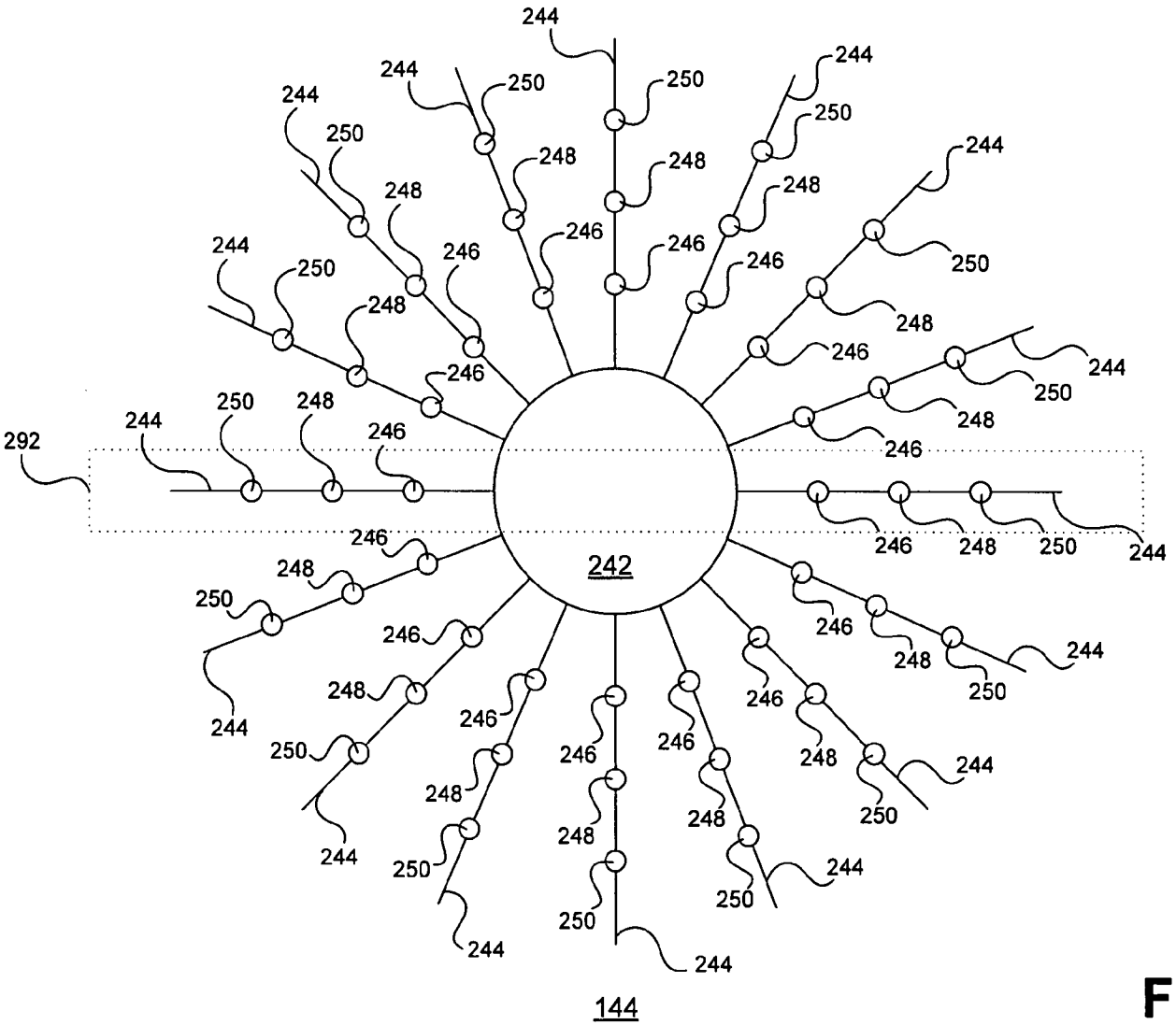
FIG. 2 is a top view of one embodiment of a configurable tophat assembly of a Frequency Agile Electrically Small Tactical AM Broadcast Band Antenna System.

FIG. 2 is a top view of one embodiment of a configurable tophat assembly of a FAAS. As shown in FIG. 2, configurable tophat assembly 144 includes tophat disc 242, tophat wires 244 and tophat jumpers 246, 248, 250. Tophat disc 242 comprises a conductive material capable of transmitting radio frequency signals such as aluminum or copper. In one embodiment, tophat disc 242 comprises copper. Tophat disc 242 provides a common electric node for tophat wires 244. Tophat disc 242 is operatively coupled to tophat wires 244.

Tophat wires 244 comprise a conductive material. In one embodiment, tophat wires 244 comprise copper. In one embodiment, tophat wires 244 comprise sixteen separate copper wires. In one embodiment, tophat wires 244 are approximately 99 feet in length. Tophat wires 244 are segmented by tophat jumpers 246, 248, 250 at predetermined lengths so that configurable tophat assembly 144 can have multiple configurations. Tophat jumpers 246, 248, 250 can be in one of two states: an electrical open or an electrical short. In one embodiment, tophat jumpers 246, 248, 250 comprise an insulator, tophat wire connectors and a common node, where the tophat wire connectors are connected to separate and adjacent segments of tophat wire 244. In an electrical open state, the tophat wire connectors are not connected to each other or the common node. In an electrical short state, the tophat wire connectors are connected to each other though the common node. Tophat jumpers 246, 248, 250 are situated at predetermined lengths along tophat wires 244 and are designed to change the operational properties of configurable tophat assembly 144. Those skilled in the art shall recognize that these predetermined lengths can be changed without departing from the scope and spirit of the antenna system.

In one embodiment, tophat jumpers 246 are situated 25 feet from a proximal end of tophat wires 244 (i.e., the ends of tophat wires 244 that are closest to tophat disc 242). In one embodiment, tophat jumpers 248 are situated 45 feet from a proximal end of tophat wires 244. In one embodiment, tophat jumpers 250 are situated 75 feet from a proximal end of tophat wires 244. Cutaway 292 represented by a box having dashed lines is now described in FIG. 3.

Figure 3:
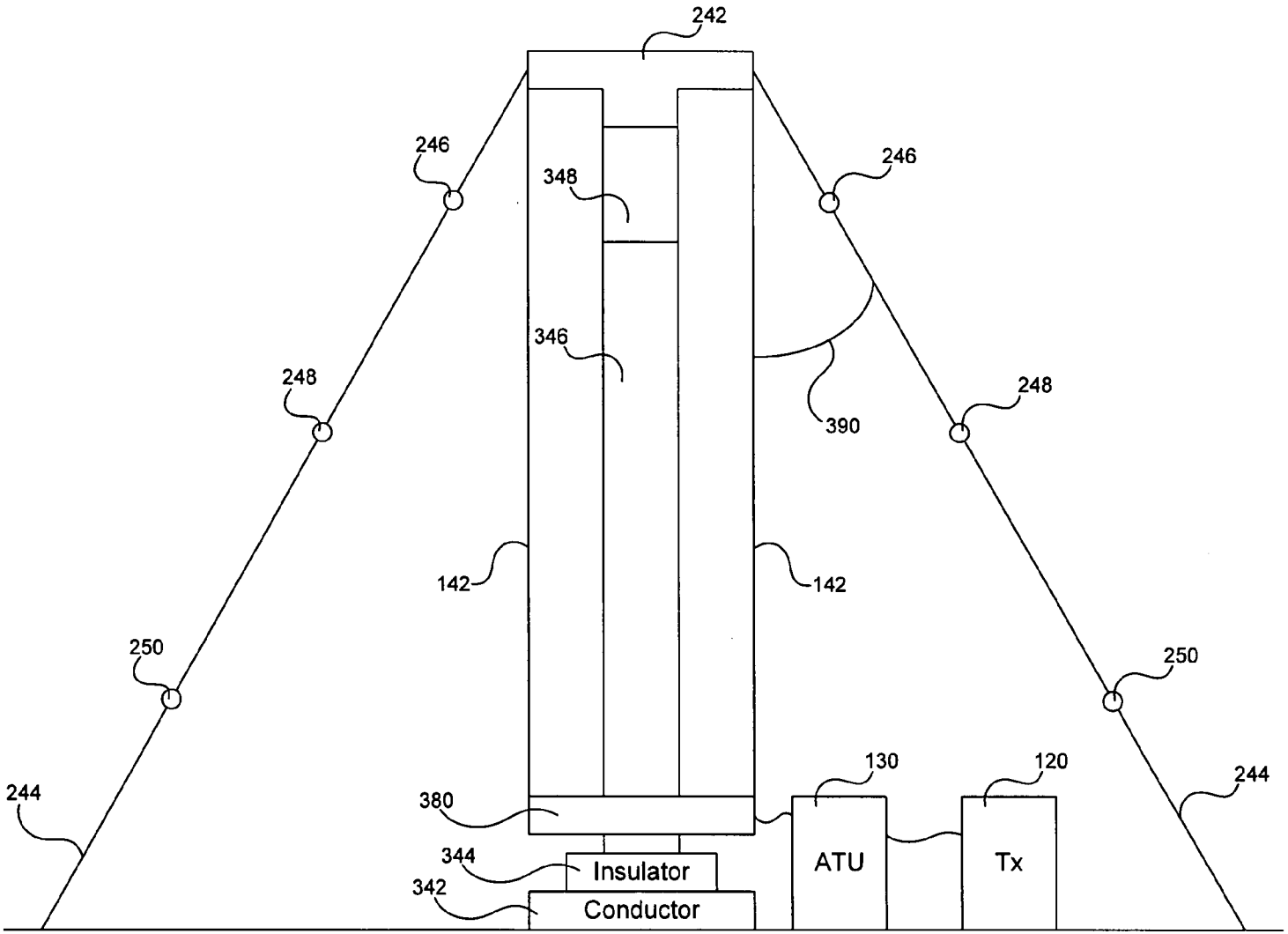
FIG. 3 is a cutaway side view of one embodiment of a Frequency Agile Electrically Small Tactical AM Broadcast Band Antenna System.

FIG. 3 is a cutaway side view of one embodiment of a FAAS. FIG. 3 is a side view representing cutaway 292 of FIG. 2. As shown in FIG. 3, FAAS 300 includes transmitter (Tx) 120, ATU 130, tophat disc 242, tophat wires 244, tophat jumpers 246, 248, 250, conductor base 342, insulator base 344, base mast 346, insulator mast 348, mast ring 380 and mast wires 142. Conductor base 342 comprises a conductive material. In one embodiment, conductor base 342 comprises copper. In one embodiment, conductor base 342 has a thickness of ¼ inch. In one embodiment, conductor base 342 comprises a thin, flat disc. Conductor base 342 is operatively coupled to a ground rod (not shown in any FIGURES), which is inserted into the ground. Conductor base 342 is operatively coupled to a network of ground radial wires (not shown in any FIGURES). In one embodiment, a network of ground radial wires comprises lengths of conductive wire that have proximal ends operatively coupled to conductor base 342 and distal ends situated in an imaginary concentric circle that has a diameter greater than a diameter of conductor base 342, wherein the ground radial wires are approximately evenly spaced with respect to radians around conductor base 342 (i.e., with respect to a top view). Conductor base 342 is operatively coupled to insulator base 344, which isolates base mast 346 from earth ground.

Insulator base 344 comprises an insulator material. In one embodiment, insulator base 344 comprises fiberglass. In one embodiment, insulator base 344 comprises epoxy resin and glass substrate. In one embodiment, insulator base 344 comprises G10. In one embodiment, insulator base 344 comprises a flat disc that is approximately greater than or equal to four inches in thickness. Insulator base 355 is operatively coupled to base mast 346.

Base mast 346 comprises a sturdy material. In one embodiment, base mast 346 comprises steel. In one embodiment, base mast 346 comprises aluminum. In one embodiment, base mast 346 comprises a telescopic boom. Base mast 346 has a length sufficient enough to situate tophat disc 242 a predetermined distance above ground. In one embodiment, tophat disc 242 is approximately 60 feet above ground. Base mast 346 provides support for insulator mast 348 and configurable tophat assembly 242. In one embodiment, base mast 346 further comprises non-conducting guy wires to provide structural support. In one embodiment, base mast 346 further comprises multiple tiers of guy wires at various lengths along base mast 346. Base mast 346 is operatively coupled to insulator mast 348.

Insulator mast 348 comprises an insulator material. In one embodiment, insulator mast 348 comprises fiberglass. In one embodiment, insulator mast 348 comprises an epoxy resin and glass substrate. In one embodiment, insulator mast 348 comprises G10. In one embodiment, insulator mast 348 comprises a cylinder. Insulator mast 348 is operatively coupled to tophat disc 242. The configurable tophat assembly (i.e., tophat disc 242, tophat wires 244 and tophat jumpers 246, 248, 250) have been described above with reference to FIG. 2, and thus, will not be described again. Angle 390 is formed between an imaginary vertical line and tophat wires 244. In one embodiment, angle 390 is approximately equal to 60 degrees.

Mast wires 142 are operatively coupled to tophat disc 242 so that mast wires 142 are approximately evenly spaced with respect to a radial view. Mast wires 142 are substantially parallel to base mast 346. In one embodiment, mast wires 142 comprise eight separate copper wires. Mast wires 142 are operatively coupled to mast ring 380, which provides a common electrical node for mast wires 142. Mast ring 380 is described in detail below with reference to FIG. 4. Mast wires 142 are operatively coupled to ATU 130 via mast ring 380. ATU 130 is operatively coupled to transmitter 120.

Figure 4:
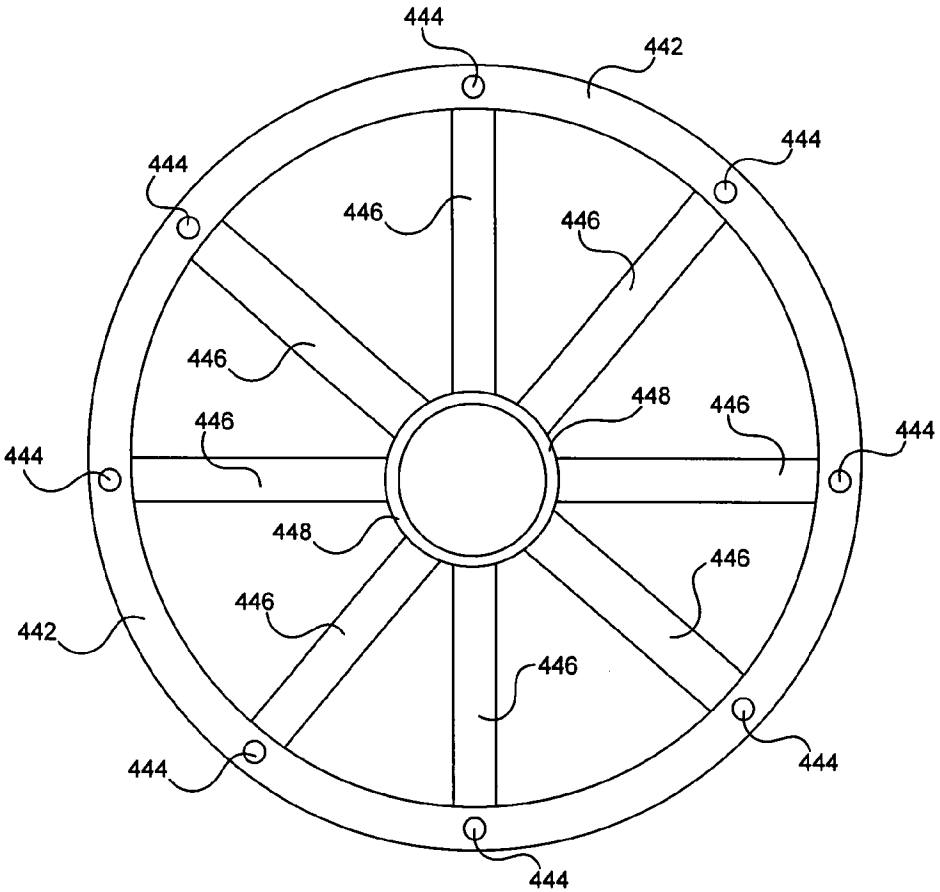
FIG. 4 is a top view of one embodiment of one component of a Frequency Agile Electrically Small Tactical AM Broadcast Band Antenna System.

FIG. 4 is a top view of one embodiment of one component of a FAAS. As shown in FIG. 4, mast ring 380 comprises conductor ring 442, mast ring mast wire couplers 444, radial supports 446 and base mast coupler 448. Base mast coupler 448 comprises a sturdy material designed to operatively couple support mast ring 380 to base mast 346 of FIG. 3 (not shown in FIG. 4). Base mast coupler 448 has an inner diameter slightly larger than an outer diameter of base mast 346 of FIG. 3. In one embodiment, base mast coupler 448 comprises insulator material. In one embodiment, base mast coupler 448 comprises conductor material. Radial supports 446 comprise an insulator material and are designed to operatively couple base mast coupler 448 and conductor ring 442 to provide support for conductor ring 442. In one embodiment, mast ring 380 comprises eight radial supports 446.

Conductor ring 442 comprises a conductive material. In one embodiment, conductor ring 442 comprises copper. Mast ring mast wire couplers 444 are designed to operatively couple mast wires 142 of FIG. 3 (not shown in FIG. 4) to conductor ring 442, which provides a common electrical node. Mast ring mast wire couplers 444 comprise conductive material. In one embodiment, mast ring mast wire couplers 444 comprise metal screws. In one embodiment, mast ring mast wire couplers 444 comprise metal nuts and bolts.

Figure 5:
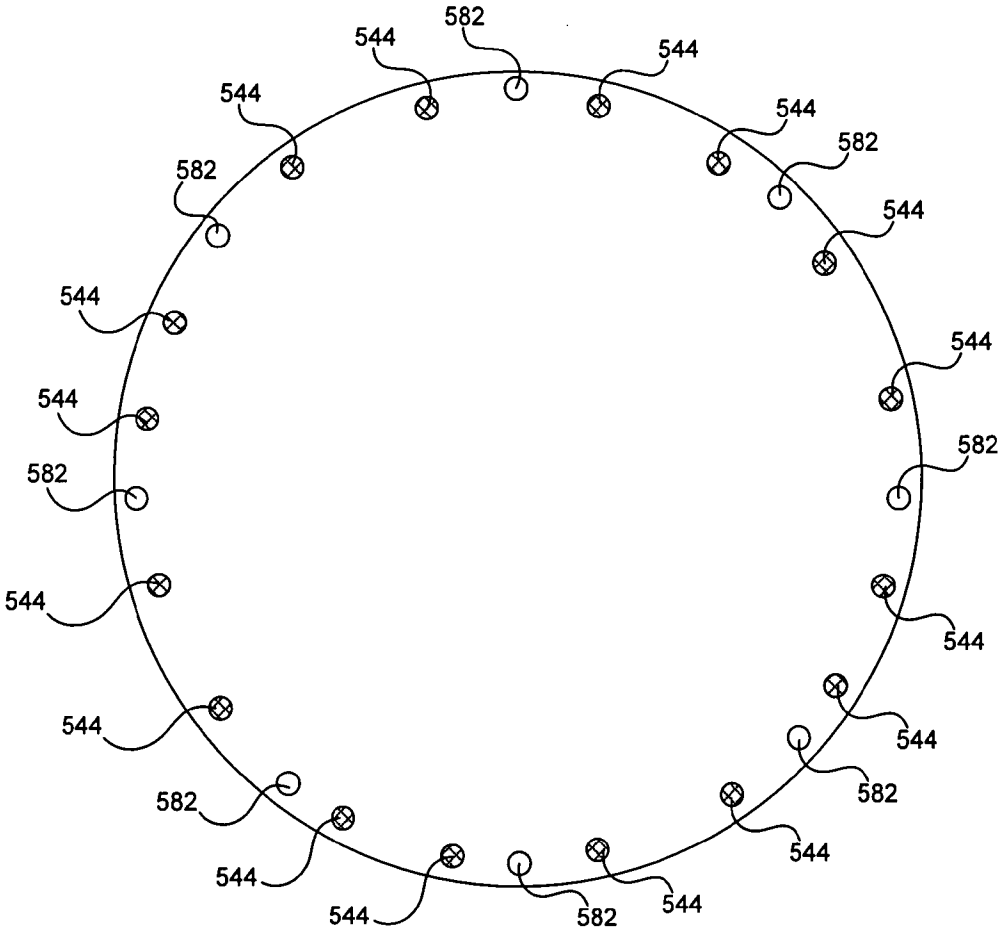
FIG. 5 is a top view of one embodiment of one component of a Frequency Agile Electrically Small Tactical AM Broadcast Band Antenna System.

FIG. 5 is a top view of one embodiment of one component of a FAAS. As shown in FIG. 5, tophat disc 242 comprises tophat wire couplers 544 and tophat mast wire couplers 582. Tophat wire couplers 544 and tophat mast wire couplers 582 are substantially similar to mast ring mast wire couplers 444 of FIG. 4, and thus, are not described in detail again. Tophat wire couplers 544 operatively couple tophat disc 242 and tophat wires 244 of FIGS. 2 and 3 (not shown in FIG. 5). Tophat mast wire couplers 582 operatively couple tophat disc 242 and mast wires 142 of FIG. 3 (not shown in FIG. 5).

To provide a better understanding of the operation of the exemplary embodiments of FAAS described above, an exemplary operation is now described with reference to FIGS. 1-3. An operator (who does not need to be a broadcast engineer) configures tophat jumpers 246, 248, 250 depending on factors such as desired operating frequency, local topography and tuner electronics. After raising configurable tophat assembly 144 of FIG. 2 via base mast 346 and insulator mast 348 of FIG. 3, the operator attempts to tune the FAAS to a desired operating frequency using ATU 130. Upon failure to tune the FAAS, the operator reconfigures tophat jumpers 246, 248, 250 to a different configuration from the original configuration. The operator may be required to lower configurable tophat assembly 144 to reconfigure tophat jumpers 246, 248, 250 and raise configurable tophat assembly 144 after reconfiguration.

After raising configurable tophat assembly 144 of FIG. 2 via base mast 346 and insulator mast 348 of FIG. 3, the operator attempts to tune the FAAS to a desired operating frequency (thus, the antenna is frequency agile) within the AM Broadcast band using ATU 130 which is simplistically configured using two motorized inductors. Upon failure to tune the FAAS, the operator reconfigures tophat jumpers 246, 248, 250 to a different configuration from the original configuration. The operator may be required to lower configurable tophat assembly 144 to reconfigure tophat jumpers 246, 248, 250 and raise configurable tophat assembly 144 after reconfiguration, a task done without engineering assistance. The operator continues to attempt tuning and reconfiguring until tuning the FAAS to the desired operating frequency is accomplished using two simple switches to control the two motorized inductors.

Those experienced in the art will recognize that the configurable tophat assembly is adjusted such that the input impedance of the antenna is kept within that certain region whereupon a dual inductor ATU configuration can be used. The operator continues to attempt tuning and reconfiguring until tuning the FAAS to the desired operating frequency is accomplished.

What is claimed is:

1. An apparatus, comprising:

a transmitter designed to transmit radio frequency signals;

an antenna tuning unit operatively coupled to said transmitter, designed to tune said apparatus to a desired frequency;

a plurality of mast wires operatively coupled to said antenna tuning unit, designed to receive and output radio frequency signals; and a configurable tophat assembly operatively coupled to said plurality of mast wires, comprising:

a tophat disc comprising a conductive material, operatively coupled to said plurality of mast wires;

a plurality of tophat wires comprising a conductor material, operatively coupled to said tophat disc, designed to be configured to different lengths to change the operational properties of said configurable tophat assembly; and a plurality of tophat jumpers operatively coupled to said plurality of tophat wires, designed to help configure said plurality of tophat wires to different lengths by providing electrical open and electrical short states.

2. The apparatus of claim 1, wherein each of said tophat wires has a length approximately equal to 99 feet.

3. The apparatus of claim 1, wherein a group of said plurality of tophat jumpers is situated approximately 25 feet from a proximal end of each of said plurality of tophat wires.

4. The apparatus of claim 1, wherein a group of said plurality of tophat jumpers is situated approximately 45 feet from a proximal end of each of said plurality of tophat wires.

5. The apparatus of claim 1, wherein a group of said plurality of tophat jumpers is situated approximately 75 feet from a proximal end of each of said plurality of tophat wires.

6. The apparatus of claim 1, wherein said apparatus further comprises:

a conductor base comprising a conductive material;

an insulator base comprising an insulator material, operatively coupled to said conductor base;

a base mast comprising a structural support material, operatively coupled to said insulator base; and an insulator mast comprising an insulator material, operatively coupled to said base mast and said tophat disc.

7. The apparatus of claim 6, wherein said conductor base comprises copper.

8. The apparatus of claim 6, wherein said conductor base comprises a flat disc that is approximately greater than or equal to four inches in thickness.

9. The apparatus of claim 6, wherein said conductor base has a thickness of ¼ inch.

10. The apparatus of claim 6, wherein said insulator base comprises fiberglass.

11. The apparatus of claim 1, wherein said insulator base comprises G10.

12. The apparatus of claim 6, wherein said insulator base comprises a thin, flat disc.

13. The apparatus of claim 6, wherein said base mast comprises steel.

14. The apparatus of claim 6, wherein said base mast comprises aluminum.

15. The apparatus of claim 6, wherein said base mast comprises a telescopic boom.

16. The apparatus of claim 6, wherein said insulator mast comprises fiberglass.

17. The apparatus of claim 6, wherein said insulator mast comprises G10.

18. The apparatus of claim 6, wherein said insulator mast comprises an epoxy resin and glass substrate.

19. An apparatus, comprising:

a transmitter designed to transmit radio frequency signals;

an antenna tuning unit operatively coupled to said transmitter, designed to tune said apparatus to a desired frequency;

a plurality of mast wires operatively coupled to said antenna tuning unit, designed to receive and output radio frequency signals;

a configurable tophat assembly operatively coupled to said plurality of mast wires, comprising:

a tophat disc comprising a conductive material, operatively coupled to said plurality of mast wires;

a plurality of tophat wires comprising a conductor material, operatively coupled to said tophat disc, designed to be configured to different lengths to change the operational properties of said configurable tophat assembly; and a plurality of tophat jumpers operatively coupled to said plurality of tophat wires, designed to help configure said plurality of tophat wires to different lengths by providing electrical open and electrical short states;

a conductor base comprising a conductive material;

an insulator base comprising an insulator material, operatively coupled to said conductor base;

a base mast comprising a structural support material, operatively coupled to said insulator base; and an insulator mast comprising an insulator material, operatively coupled to said base mast and said tophat disc.

20. An apparatus, comprising:

a transmitter designed to transmit radio frequency signals;

an antenna tuning unit operatively coupled to said transmitter, designed to tune said apparatus to a desired frequency;

a plurality of mast wires operatively coupled to said antenna tuning unit, designed to receive and output radio frequency signals;

a configurable tophat assembly operatively coupled to said plurality of mast wires, comprising:

a tophat disc comprising a conductive material, operatively coupled to said plurality of mast wires;

a plurality of tophat wires comprising a conductor material, operatively coupled to said tophat disc, designed to be configured to different lengths to change the operational properties of said configurable tophat assembly; and a plurality of tophat jumpers operatively coupled to said plurality of tophat wires, designed to help configure said plurality of tophat wires to different lengths by providing electrical open and electrical short states;

a conductor base comprising a conductive material;

an insulator base comprising an insulator material, operatively coupled to said conductor base;

a base mast comprising a structural support material, operatively coupled to said insulator base; and an insulator mast comprising an insulator material, operatively coupled to said base mast and said tophat disc;

a plurality of ground radial wires comprising a conductive material, operatively coupled to said conductor base.

* * * * *